United States Patent [19]

Hunter et al.

[11] Patent Number: 4,865,310

[45] Date of Patent: Sep. 12, 1989

[54] STACKER-SORTER ARRANGEMENT FOR SHEET PART PIECES

[75] Inventors: James R. Hunter, Chadds Ford; Victor Chun, Holland, both of Pa.

[73] Assignee: Warner & Swasey Company, Cleveland, Ohio

[21] Appl. No.: 194,693

[22] Filed: May 16, 1988

[51] Int. Cl.[4] ..... B65H 29/38

[52] U.S. Cl. ..... 271/296; 271/84; 271/299; 271/312

[58] Field of Search ..... 271/225, 299, 300, 296, 271/279, 306, 307, 308, 312, 84

[56] References Cited

U.S. PATENT DOCUMENTS

| | | | |
|---|---|---|---|
| 1,974,241 | 9/1934 | Hewitt | 271/84 |
| 3,405,932 | 10/1968 | Dame | 271/84 X |
| 3,695,464 | 10/1972 | Kaji | 271/84 X |
| 4,678,180 | 7/1987 | Tamura | 271/296 |

*Primary Examiner*—Richard A. Schacher

*Attorney, Agent, or Firm*—John R. Benefiel; Raymond J. Eifler

[57] ABSTRACT

A sorter-stacker arrangement for sheet part pieces (17) such as are produced by a punch press (18), in which part pieces are unloaded onto a sorter table (50) in a located position against any one of a row of stops (52), and conveyed along an X-axis as by translation of the conveyor table therealong. A pair of storage racks (36) are disposed on opposite sides of the sorter table (50), each having a vertical array of open spaces facing the sorter table (50). The sorter table (50) is elevated to the preselected position, and advanced into the appropriate storage space (38). After lowering of the stripper gates (104), the sorter table (50) is retracted to align the part piece 17 by contact of the stripper gate (104) with the inside edge of the part piece (17) and stripped on to the stack as the sorter table (50) returns to the central position.

14 Claims, 7 Drawing Sheets

FIG-9A
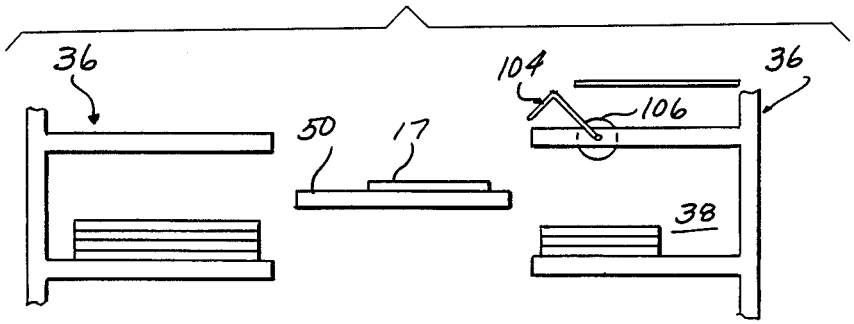
FIG-9B
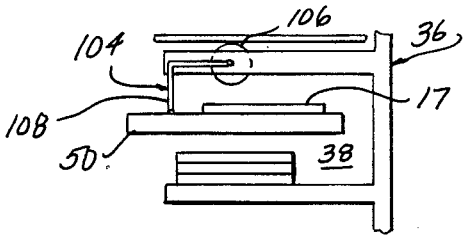
FIG-9C
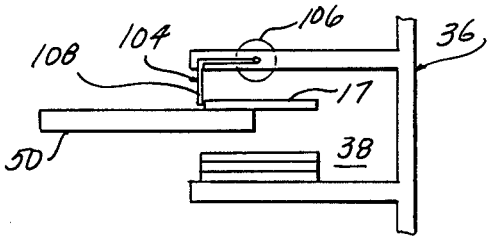
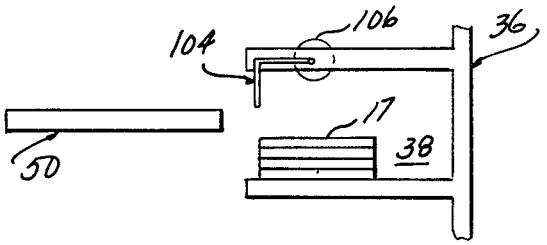
FIG-9D

STACKER-SORTER ARRANGEMENT FOR SHEET PART PIECES

BACKGROUND OF THE INVENTION

This invention concerns sorters for distributing parts to various storage locations, and more particularly sorters for piece parts made of sheet material as are produced by punch presses.

In conventional arrangements, a system of horizontal conveyors distribute the sheet parts to various horizontally spaced bin locations, where the parts are dumped off the end of a conveyor. These arrangements are wasteful of floor space, offer only limited capability for accommodating different parts, and the part pieces when sorted, are not disposed for convenient further handling.

It is an object of the present invention to provide a stacker sorter arrangement for sheet part pieces which is capable of sorting and stacking a large number of different sheet part pieces in a relatively small floor area, and which stack the part pieces in their respective sorted locations conveniently accessible for further handling.

SUMMARY OF THE INVENTION

The stacker-sorter arrangement of the present invention includes a sorter table adapted to receive various sheet part pieces either from a tilt table or conveyor punch press unloader, the part pieces able to be located at any of a series of discrete spaced locations thereon.

The part piece on the sorter table can be moved along an X-axis defined by the longitudinal axis of the sorter table, either by movement of the sorter table itself, or by a conveyor means on the sorter table.

The sorter table thereafter is elevated to raise a part piece disposed thereon to a particular vertical location along a Z-axis in either of opposing multilevel storage racks located on each side of the sorter table.

Upon locating the part piece at the appropriate X–Z axis location, the sorter table is powered out laterally along an orthogonal Y-axis to be positioned within one of a plurality of storage spaces at locations arrayed in each storage rack. A series of stripper gates are thereafter pivoted to position a finger portion behind a trailing edge of the piece part, so that upon retraction of the sorter table, the piece part is stripped, sliding off the sorter table onto a horizontal support forming a part of the storage space.

Retractable stops may be utilized located in transverse Y-axis grooves formed into the top surface of the sorter table, the movable stops selectively defining discrete X-axis locations for the piece parts on the sorter table. The transverse grooves also receive the finger of a respective stripper gate in the lowered stripping position to insure engagement with the rem edge of a stripped piece, and thereby achieve accurate alignment of each successive piece part to form a stack in the storage space.

Retractable ball transfer units may be employed to facilitate sliding transfer of the piece parts on and off the sorter table.

The present invention has the advantage of enabling sorting of a large number of different piece parts within a relatively small floor area.

Another advantage is the ability of the arrangement to form neat stacks of the sorted piece parts, in which the individual piece parts are accurately aligned with each other. The stacks are conveniently accessible for subsequent handling. The stacking operation is carried out without significant rubbing between adjacent piece parts in the stack, an important advantage for louvered parts which could hang up on each other.

The arrangement also has the advantage of being flexible in adapting to great variations of piece part configurations while most efficiently handling and storing the same.

DESCRIPTION OF THE DRAWINGS

FIGS. 9A–9D are diagrammatic front elevational view of the major components of the sorter-stacker according to the present invention, depicting the successive movement of the components.

DETAILED DESCRIPTION

Figure 1:
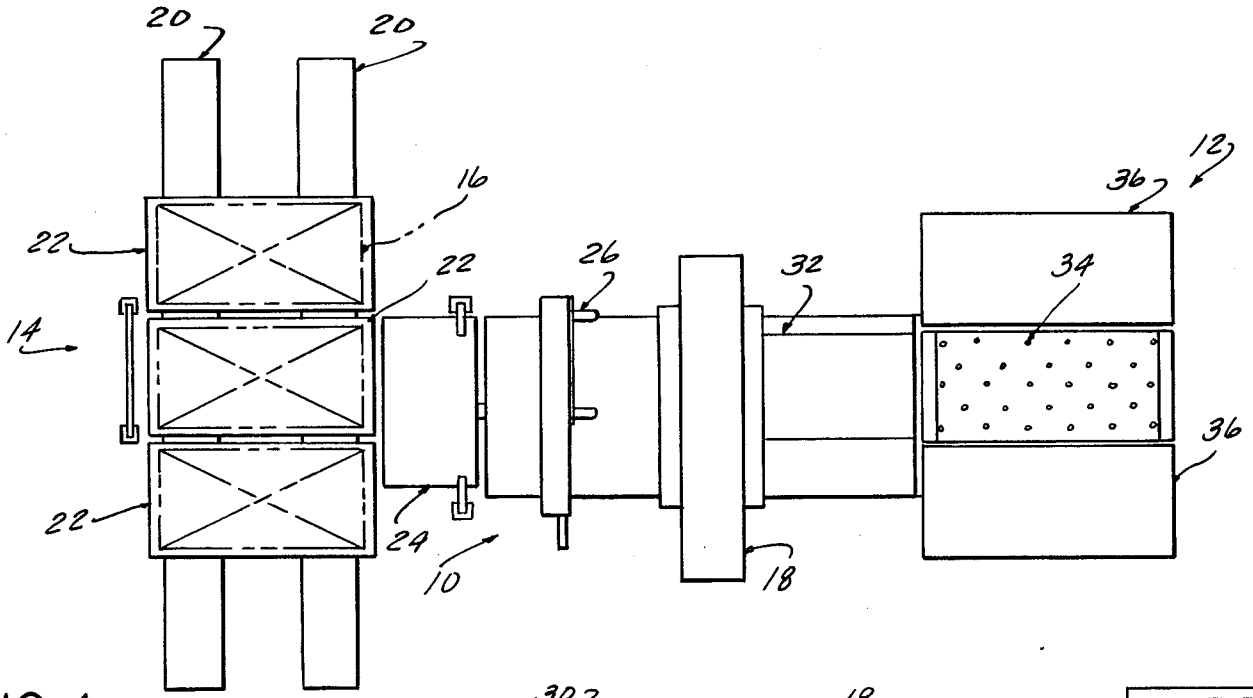
FIG. 1 is a plan view of a typical punch press installation utilized with a sorter and stacker arrangement according to the present invention.
Figure 2:
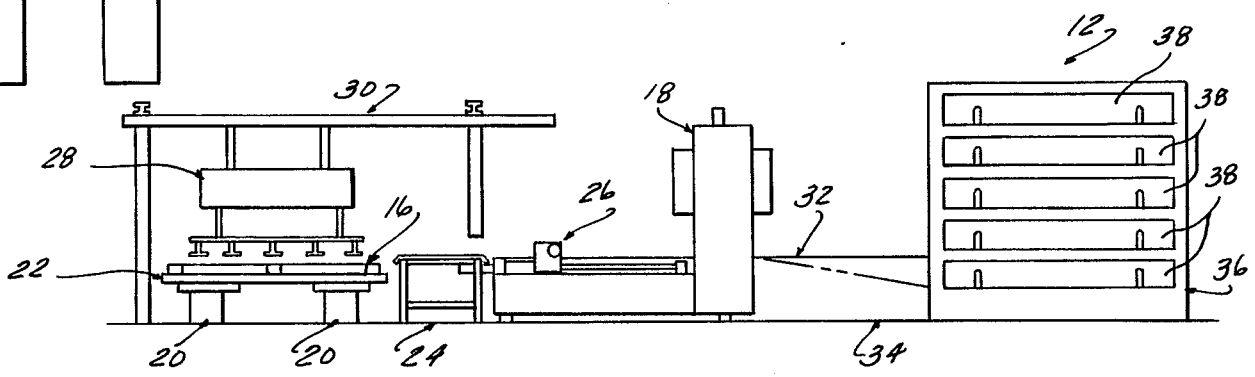
FIG. 2 is a side elevational view of the punch press installation and sorter stacker arrangement shown in FIG. 1.

FIGS. 1 and 2 depict a conventional punch press installation 10 combined with a sheet sorter-stacker arrangement 12 according to the present invention.

The punch press installation 10 includes conventional apparatus 14 for feeding sheet material blanks 16 to the press 18. Such apparatus 14 may include chain conveyors 20 moving pallets 22 supporting stacks of sheet material blanks 16 opposite a support table 24 and punch press X,Y table 26. A lifting-loader 28 supported on an overhead structure 30 enables lifting of sheet blanks 16 from the pallets 22 onto the support table 24 to be fed into the punch press 18 for performance of the punching operation.

The punch press 18 pictured also includes an unloading table 32 which is of a tilt table design, causing a gravity induced sliding of a finished piece part 17 onto a sorter table assembly 34 included in the sorter-stacker arrangement 12 according to the present invention. A pair of oppositely disposed storage racks 36 are spaced apart to accommodate the sorter table assembly 34 therebetween. Each sorter storage rack 36 includes a plurality of storage spaces 38 arranged in a vertical array, each providing a horizontal surface for receiving sheet piece parts to allow accumulation of a stack of a particular piece part 17.

Figure 3:
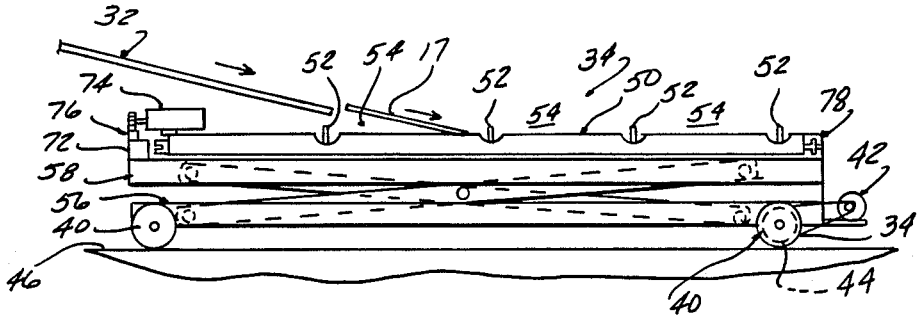
FIG. 3 is an enlarged side elevational view of a sorter table assembly utilized in the sorter stacker arrangement shown in FIGS. 1 and 2, with the sorter table in the lowered position.

FIG. 3 illustrates the details of a first embodiment of the sorter table assembly 34, here taking the form of a cart supported on wheels 40, two which are powered by means of an X-axis drive motor 42 driving a sprocket 44 via chain 43. The wheels 40 on each side of the sorter table 34 are fit to a vee rail 46 so as to provide guided linear movement in a direction away from the punch press 18, herein referred to as X-axis movement.

The sorter table assembly 34 includes a generally planar topped sorter table 50 having a series of X-axis spaced locator stops 52 the intermediate spaces 54 each define a plurality discrete locations for receiving part pieces 17. The X-axis movement of the sorter table assembly 34 enables positioning of any of the spaces 54 just forward of the lowered end of the tilt table 32 to receive a finished part piece 17 slid down the same to be unloaded.

Figure 4:
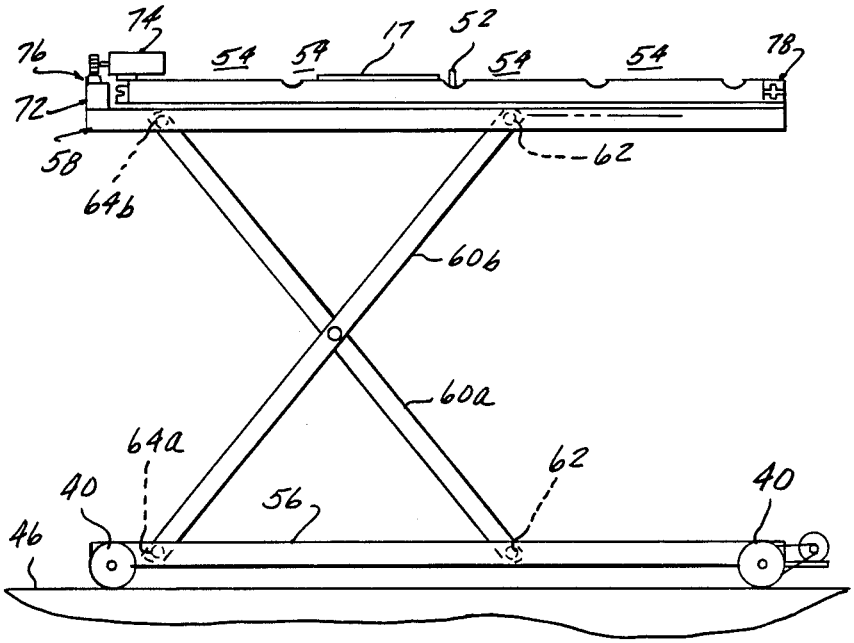
FIG. 4 is a side elevational view of the sorter table assembly shown in FIG. 3.
Figure 5:
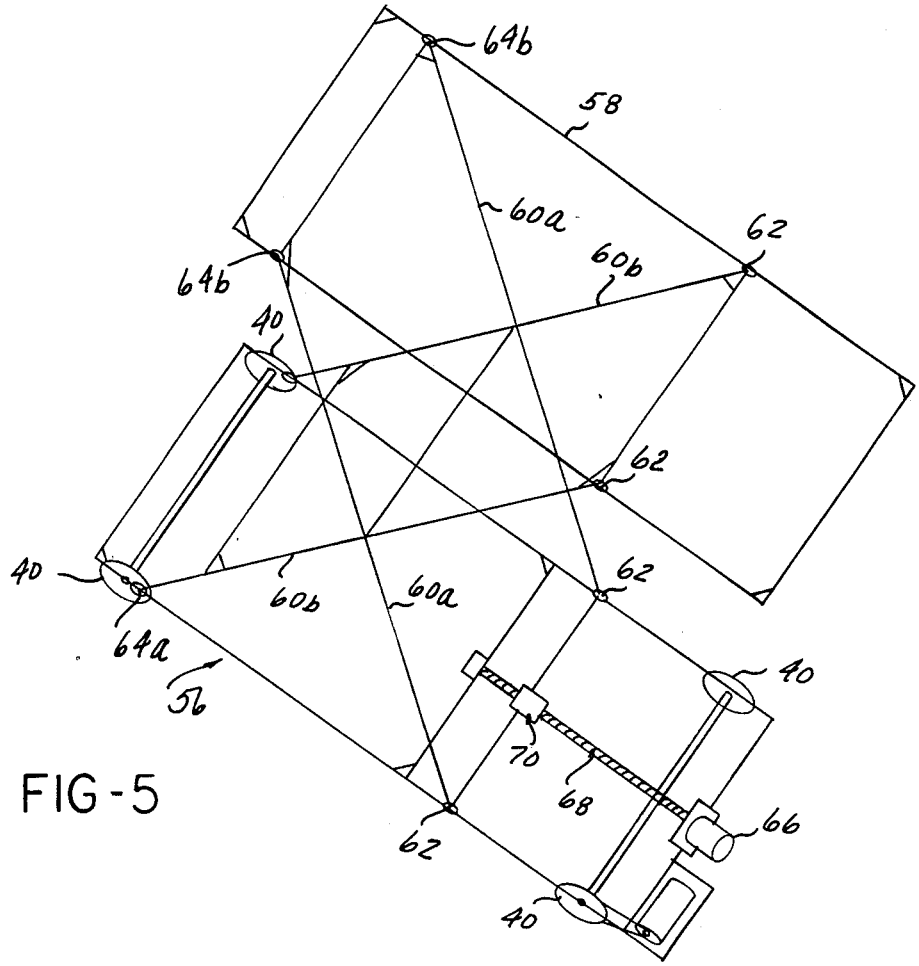
FIG. 5 is a diagrammatic perspective view of the sorter table shown in FIGS. 3 and 4, depicting the basic relationship of the component structures.
Figure 6:
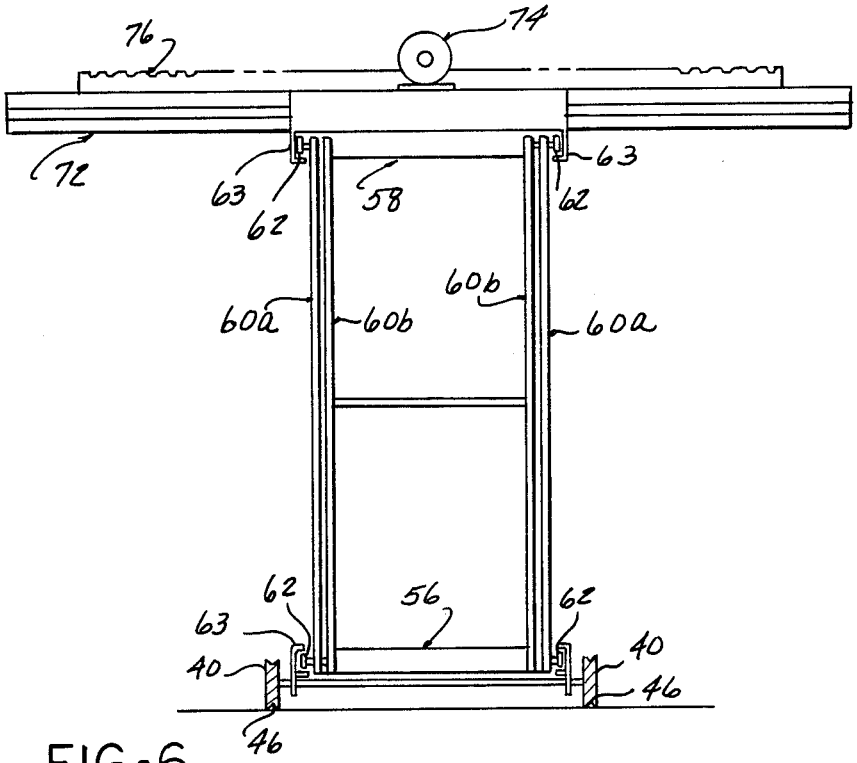
FIG. 6 is a front sectional view taken through the sorter table assembly shown in FIGS. 3–5.

FIGS. 4–6 best illustrate that the sorter table 50 is supported for elevational movement along a Z-axis by means of a lower platform 56 on which wheels 40 are supported, and on upper platform 58. Pairs of scissor members **60*a*, 60*b* are pivoted together and carry rollers 62 at one end, received in C-tracks 63 in the lower platform 56 and upper platform 58. The other end of each is pivoted at 64*a* to the lower platform and at 64*b* to the upper platform. Thus, upon energization of a Z-axis servo motor 66 and rotation of a lead screw 68 thereby, a fixed nut 70 causes advance or retraction of the lower end of one of the scissor members 60*a*, in turn causing elevation or lowering of the upper platform 58 and sorter table 50, providing movement in the Z-axis to carry a finished part piece 17 opposite a particular storage space 38 of the storage racks 36**.

The sorter table 50 itself is supported for lateral movement along a Y-axis in a horizontal plane orthogonal to the X-axis by virtue of being supported at the punch press end by a guide track assembly 72, fixed to the upper platform 58 to be cantilevered out in either Y-axis direction. The sorter table is driven by a Y-axis servomotor drive arrangement 74 driving a gear rack 76 affixed along the top of the guide track assembly 72.

The guide track assembly 72 is positioned just to the rear of the punch press end of the storage racks 36 in the fully advanced position of the sorter table assembly 34 along the X-axis, so as to allow elevating movement without any interference therebetween.

The other end of the sorter table 50 remote from the punch press 18 is supported on a roller-track extension system 78, allowing Y-axis movement thereof into a respective storage space 38.

Figure 8:
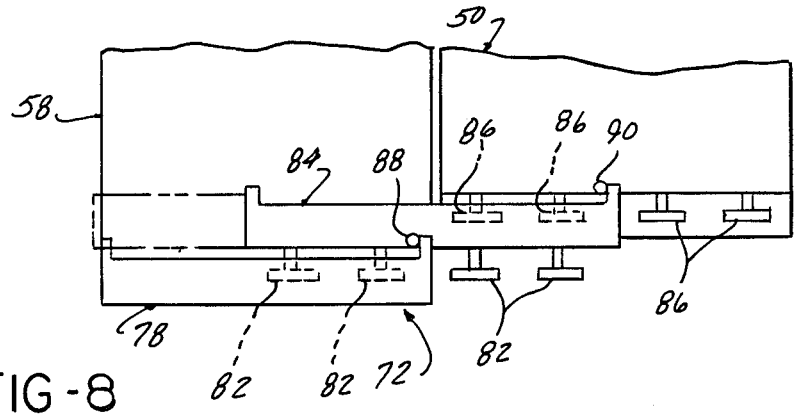
FIG. 8 is a diagrammatic plan view of the relative movement of the table top assembly components.
Figure 7:
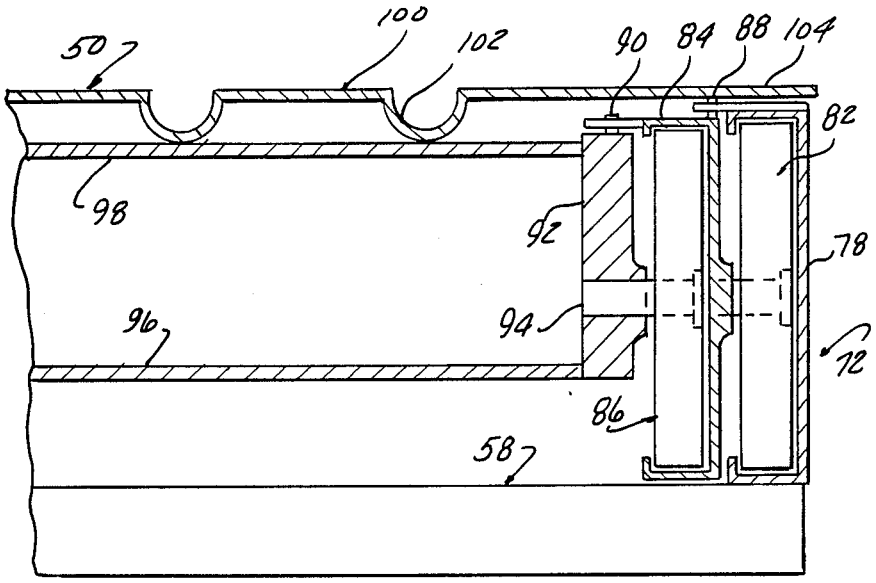
FIG. 7 is an enlarged sectional view of the table top assembly included in the sorter table assembly of FIGS. 3–6.

FIGS. 7 and 8 illustrate the details of the roller track extension system 78 used to support the outboard end of the sorter table 50 and afford in-and-out movement thereof in either Y-axis direction a distance equal to the full width of the sorter table 50.

This system 72 includes a first C-track member 78 fixed to the upper platform 58, with a spaced series of rollers 82 received therein. The rollers 82 are in turn mounted to a second C-track member 84 receiving a second series of rollers 86 supported on the sorter table 50 itself.

Suitable stop pins 88, 90 limit the extension of each C-track 78, 84 to insure two roller support in the fully extended position.

The sorter table 50, as shown in FIG. 7, is constructed of a relatively heavy gauge side wall 92 having axle pins 94 seated therein, mounting rollers 86, with lighter gauge spaced horizontal plates 96, 98 welded thereto. A contoured surface plate 100, having curved shaped transverse grooves 102 is welded or otherwise affixed on top, having a covering section 104 overlying the roller track extension system 78.

FIGS. 9A–9D illustrate the essential movements involved in stacking finished part pieces 17 in a storage space 38, once the sorter table 50 carrying a particular part piece 17 has been moved to the correct X, Z axes location by the mechanisms described above.

An angled stripper gate 104 is pivoted above each storage space 38 and initially is held in a retracted position leaving clearance for entry of the sorter table 50 upon being driven along the Y-axis as described above to carry the part piece 17 entirely within the storage space 38.

At this point, a rotary actuator 106 moves the stripper gate 104 downward against the sorter table 50, with a finger portion 108 behind the trailing edge of the part piece 17. The sorter table 50 is then retracted, with finger 106 engaging and restraining the part piece 17, so as to be stripped from the sorter table 50 and deposited atop the stack of previously handled part pieces 17. All of the part pieces 17 are aligned, since the trailing edge of all are brought into registry with the finger portions 108 at the point of deposit in the storage cavity 38.

Figure 10:
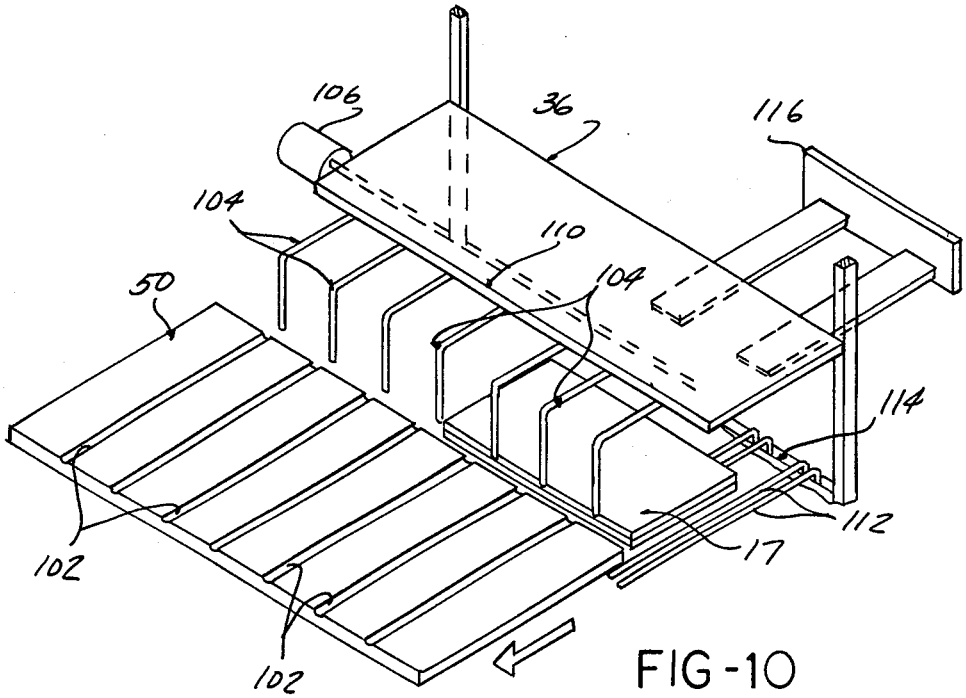
FIG. 10 is a diagrammatic perspective view of the major components of the sorter-stacker arrangement of the present invention.
Figure 11:
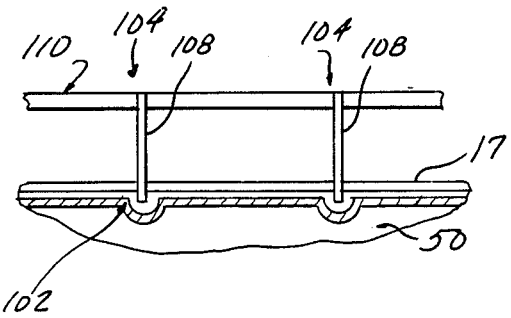
FIG. 11 is a fragmentary side elevational view of the table top cover and stripper arms of the sorter-stacker arrangement of the present invention, illustrating the engagement with a part piece to be sorted and stacked.

FIGS. 10 and 11 depict further details of the arrangement, showing that a number of the stripper gates 104 are arrayed along the length of the sorter table 50, each connected to an actuator rod 110 driven by an actuator 106 to be rotated in unison. Each stripper gate 104 finger portion 108 is aligned with a respective groove 102 in the sorter table 50, so as to insure trapping of the rear or trailing edge of the part piece 17.

The storage racks 36 are preferably constructed of spaced pairs of angled rods 112 cantilevered out from a frame member 114. This allows access with the fork 116 of a lift truck to remove the stacks from the rear of the storage racks 36.

Figure 13:
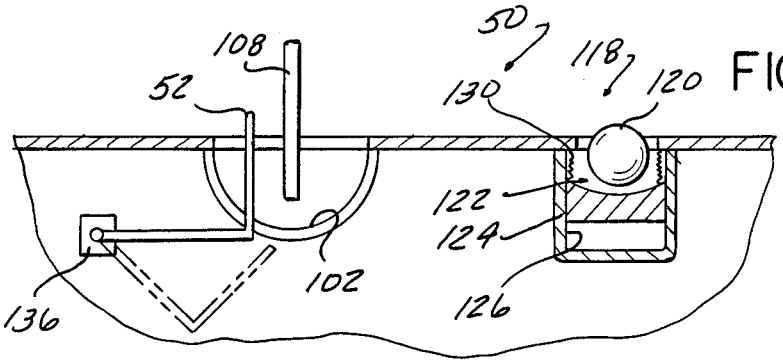
FIG. 13 is an enlarged sectional view of a portion of a sorter table top assembly shown in FIG. 12.
Figure 12:
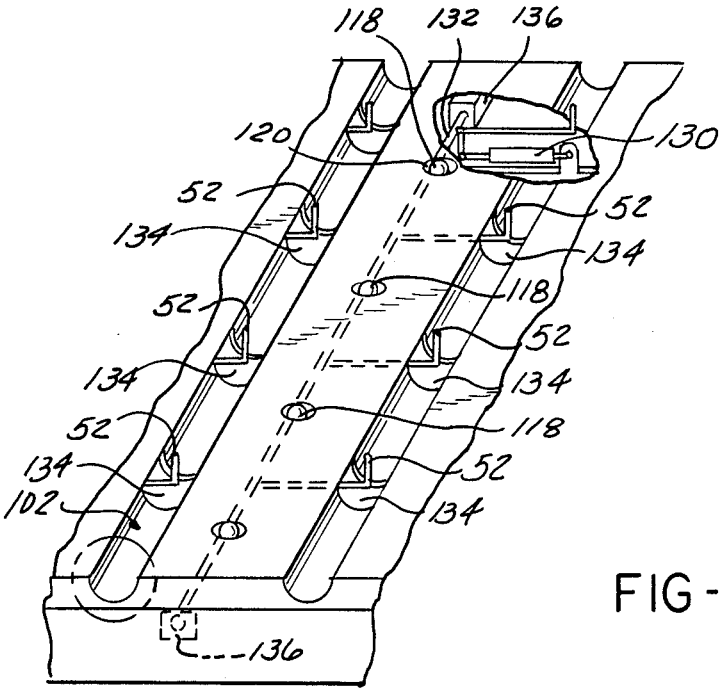
FIG. 12 is a transverse perspective view of a fragment of the table top assembly incorporated in the stacker-sorter arrangement of FIGS. 1–11.

FIGS. 12 and 13 reveal further details of the sorter table construction, which includes a series of conventional ball transfer units 118 arrayed along the flat surfaces intermediate the grooves 102. Ball transfer units 118 are well known devices, in which relatively large diameter balls 120 protrude above the mounting surfaces, which are themselves supported on small diameter ball bearings 122 such that there is only very low friction resistance to rotation in any direction. Part pieces 17 can thus slide freely in any direction on the sorter table 50. The ease in which the part pieces 17 can slide is preferably reduced when the sorter table 50 is being moved to prevent the part piece 17 from being shifted, and thus the ball transfer units 118 may be retractable in the general manner known in the art. This can be accomplished by providing pistons 124 mounted in air chambers 126, air pressure applied to overcome retraction springs 130 tending to retract the balls 120 when the ball units 118 are to be activated.

The stops 52 are offset from the fingers 106 in the grooves 102, as shown in FIG. 13 to eliminate any contact therebetween. The stops 52 also may be retractable to accommodate various sized part pieces 17 which may cover more than the distance between successive rows of stops 52. This can be accomplished by mounting each row of stop 52 to a common actuator rod 132, so as to be aligned and extending through a slot 134 in the groove 102. Each end of the actuator rod 132 is mounted in a bearing 136, with an actuator cylinder 130 mounted to allow rocking of the actuator rod 132, and raising or lowering of the stops 52.

Figure 14:
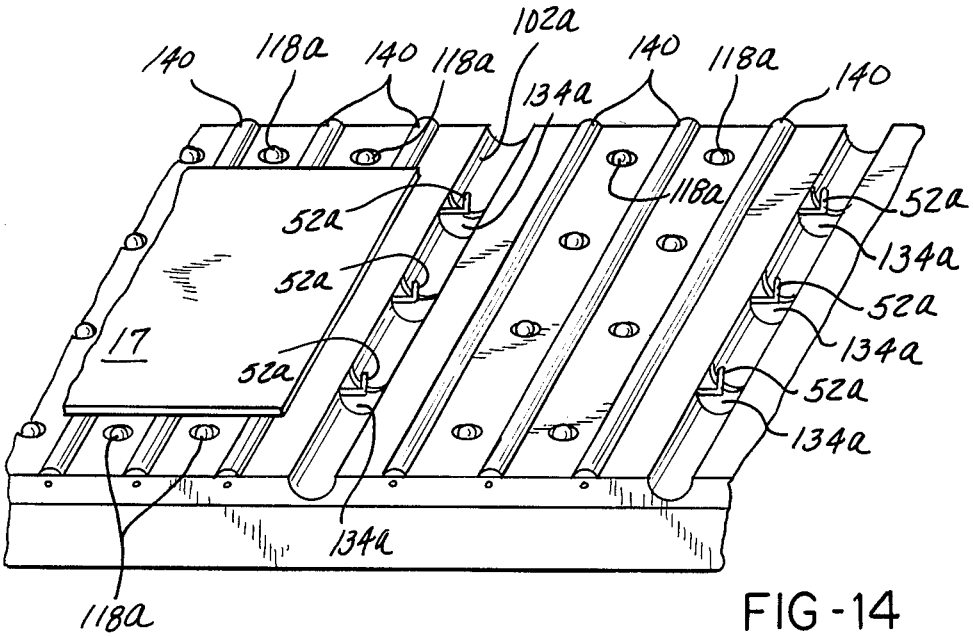
FIG. 14 is a perspective fragmentary view of a sorter table assembly of an alternate configuration.

FIG. 14 shows an alternate embodiment, adapted for use with unloaders not using the tilt-table design principle, i.e. such as a simple conveyor. In this instance, the sorter table 50*a* is not mounted for translation along the X-axis, but rather conveyor means are provided to drive the part pieces 17 along the surface of the sorter table 50*a*.

This can take the form of a series of spaced power driven rollers 140 arranged between the grooves 102*a*, so as to advance the part pieces 17 to a particular elevated row of stops 52*a*. Thus, driving a part piece 17 to a particular X-axis position to bring the same into alignment with a particular storage space 38 does not require translation of the sorter table 50*a* along the X-axis, although this could also be done.

In operation, the sorter table assembly 34 is set to receive a part piece in a particular space 54. The piece part 17 is then translated along the X-axis, and at the same time the sorter table 50 is raised along the Z-axis to bring the part piece to a storage space 38 whereat the particular part piece 17 is to be stacked. The sorter table 50 is then fully advanced into the storage space 38, past the stripper gates 104. After lowering of the stripper gates 104, into the grooves 102 the sorter table 50 is retracted to draw the part piece into alignment with the stack and strip the same onto the stack.

The stops 52 may be raised in various patterns to accommodate any length of part piece up to the length of the sorter table 50.

Accordingly, the above advantages are provided by the described arrangement. The use of the rows of retractable rods 52 allows efficient utilization of the storage spaces 38 for various length part pieces 17.

We claim:

1. A stacker-sorter arrangement for sheet part pieces (17) in which variously configured part pieces (17) are transported from an unloading point (32) whereat said part pieces are unloaded from apparatus (18) producing said part pieces (17) to any of a plurality of storage spaces (38) to be sorted thereby, characterized by:

a movable sorter table (50) adapted to receive part pieces (17) at said unloading point;

at least one relatively fixed storage rack (36) disposed alongside said movable sorter table (50), said storage rack having a plurality of horizontally extending open ended storage spaces (38) at various locations;

means (40,42,44,46,60,66,68,70,140) for positioning a part piece on said sorter table (50) at a location opposite any selected storage space (38);

means (72,74,76,78) moving said sorter table (50) into said selected storage space (38) and retracting said sorter table (50) out of said storage cavity by lateral movement thereof;

stripper means (104, 106) for stripping a part piece from said sorter table (50) as said sorter table (50) is retracted from said storage space (38) to deposit the same in said storage space (38); said stripper means includes at least one stripper gate (104) mounted on said storage rack above each of said storage spaces (38) and means moving said stripper gate (104) downwardly behind a trailing edge of said part piece (17) after said sorter table (50) is completely moved into said storage space (38), said stripper gate having a finger portion (108) engaging said trailing edge of said part piece to restrain said part piece (17) as said sorter table (50) is retracted and thereby strip said part piece (17) as said sorter table (50) is moved completely out of said storage space (38).

2. The stacker-sorter arrangement according to claim 1 wherein said stripper gate (104) includes a finger portion (108) movable against said sorter table (50) behind said trailing edge of said part piece (17).

3. The stacker-sorter arrangement of claim 2 wherein said sorter table (50) is formed with a series of parallel grooves (102), each aligned with a respective finger portion (108) of a stripper gate (104) and wherein said each finger portion (108) is moved into a respective groove (102) after said sorter table (50) is moved into said storage space (38).

4. The stacker-sorter arrangement according to claim 3 further including rows of stops (52) projecting out of at least several of said grooves (102), offset from said finger portion (108) of said stripper gate (104).

5. The stacker-sorter arrangement according to claim 1 wherein a series of power rollers (140) mounted on said sorter table (50) comprise at least in part said means for moving said part pieces (17) to said location opposite a preselected storage space (38).

6. The stacker-sorter arrangement according to claim 1 wherein said sorter table (50) is supported on at least one end with a roller extension track system (78) allowing said sorter table (50) to be laterally moved in said storage spaces unsupported from beneath at said at least one end.

7. The stacker-sorter arrangement according to claim 1 wherein said sorter table (50) includes a series of discrete part piece locations (54) thereon, and further including means (40,42,44,46) for moving any of said locations to said unloading point (32).

8. A stacker-sorter arrangement for sheet part pieces (17) in which variously configured part pieces (17) are transported from an unloading point (32) whereat said part pieces are unloaded from apparatus (18) producing said part pieces (17) to any of a plurality of storage spaces (38) to be sorted thereby, characterized by:

a sorter table (50) adapted to receive part pieces (17) deposited thereon at said unloading point;

at least one storage rack (36) disposed alongside said sorter table (50), said storage rack (36) having a plurality of horizontally extending open ended storage spaces (38) arranged spaced apart vertically in said storage rack (36);

means (40,42,44,46,60,66,68,70,140) for positioning a part piece deposited on said sorter table (50) at a location opposite any selected storage space (38), including means for elevating said sorter table (50);

means (72,74,76,78) moving said sorter table (50) into said selected storage space (38) and retracting said sorter table (50) out of said storage cavity by lateral horizontal movement thereof;

stripper means (104, 106) for stripping a part piece from said sorter table (50) as said sorter table (50) is retracted from said storage space (38) to deposit the same at a predetermined location in said storage space (38).

9. The stacker-sorter arrangement according to claim 8 further including a pair of storage racks (36) located with said sorter table therebetween, each of said storage racks (36) having a vertical array of storage spaces (38).

10. The stacker-sorter arrangement according to claim 8 further including means (40,42,44,46) for translating said sorter table (50) from said unloading point (32) along a path between said storage racks (36), said means comprising at least in part said means for moving said part piece (17) to said location opposite said storage space (38).

11. The stacker-sorter according to claim 10 wherein said means for translating said sorter table (50) includes wheels (40) supporting said sorter table (50) for rolling movement.

12. The stacker-sorter arrangement for sheet part pieces (17) in which variously configured part pieces (17) are transported from an unloading point (32) whereat said part pieces are unloaded from apparatus (18) producing said part pieces (17) to any of a plurality of storage spaces (38) to be sorted thereby, characterized by:

a movable sorter table (50) adapted to receive part pieces (17) deposited thereon at said unloading point;

at least one relatively fixed storage rack (36) disposed alongside said sorter table (50), said storage rack (36) having a plurality of horizontally extending open ended storage spaces (38) at various locations;

a fixed frame member (114) and series of parallel cantilevered rods (112) extending horizontally from said frame member (114) towards said sorter table (50) defining in part said storage spaces (38), said storage rack (36) open from the rear to enable removal of a stack of part pieces (17) from each of said storage spaces (38);

means (40,42,44,46,60,66,68,70,140) for positioning a part piece deposited on said sorter table (50) at a location opposite any selected storage space (38);

means (72,74,76,78) moving said sorter table (50) into said selected storage space (38) and retracting out of said storage cavity by lateral movement thereof;

stripper means (104, 106) for stripping a part piece from said sorter table (50) as said sorter table (50) is retracted from said storage space (38) to deposit the same in said storage space (38).

13. A stacker-sorter arrangement for sheet part pieces (17) in which variously configured part pieces (17) are transported from an unloading point (32) whereat said part pieces are unloaded from apparatus (18) producing said part pieces (17) to any of a plurality of storage spaces (38) to be sorted thereby, characterized by:

a movable horizontal sorter table (50) adapted to receive part pieces (17) deposited thereon at said unloading point;

at least one relatively fixed storage rack (36) disposed alongside said sorter table (50), said storage rack (36) having a plurality of horizontally extending open ended storage spaces (38) at various laterally separated locations about said storage rack;

means (40,42,44,46,60,66,68,70,140) for positioning a part piece on said sorter table (50) at a location opposite any selected storage space (38);

means (72,74,76,78) moving said sorter table (50) into said selected storage space (38) and retracting out of said storage cavity by lateral movement thereof;

stripper means (104, 106) for stripping a part piece from said sorter table (50) as said sorter table (50) is retracted from said storage space (38) to deposit the same in said storage space (38);

laterally spaced rows of stops (52) projecting upward from said sorter table (50) for locating part pieces (17) at laterally spaced locations on said sorter table (50) corresponding to said storage spaces.

14. The stacker-sorter arrangement according to claim 13 wherein said stops (52) are selectively retractable by row to allow a part piece (17) to overlie said row of stops (52).

* * * * *